US010632528B2

(12) United States Patent
Sinden et al.

(10) Patent No.: US 10,632,528 B2
(45) Date of Patent: Apr. 28, 2020

(54) METAL LEVEL OVERSHOOT OR UNDERSHOOT MITIGATION AT TRANSITION OF FLOW RATE DEMAND

(71) Applicant: Novelis Inc., Atlanta, GA (US)

(72) Inventors: Aaron David Sinden, Valleyford, WA (US); John Robert Buster McCallum, Spokane, WA (US); Robert Bruce Wagstaff, Greenacres, WA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 16/190,761

(22) Filed: Nov. 14, 2018

(65) Prior Publication Data

US 2019/0143402 A1 May 16, 2019

Related U.S. Application Data

(60) Provisional application No. 62/586,270, filed on Nov. 15, 2017, provisional application No. 62/687,379, filed on Jun. 20, 2018.

(51) Int. Cl.

| | |
|---|---|
| ***B22D 11/18*** | (2006.01) |
| ***B22D 11/20*** | (2006.01) |
| *B22D 11/103* | (2006.01) |

(52) U.S. Cl.

CPC ..... *B22D 11/181* (2013.01); *B22D 11/201* (2013.01); *B22D 11/103* (2013.01)

(58) Field of Classification Search

CPC ..... B22D 11/16; B22D 11/181–187; B22D 11/20; B22D 11/201–206; B22D 11/10; B22D 11/103

See application file for complete search history.

(56) References Cited

U.S. PATENT DOCUMENTS

| | | | |
|---|---|---|---|
| 4,498,521 | A | 2/1985 | Takeka et al. |
| 4,523,624 | A | 6/1985 | Dantzig et al. |

(Continued)

FOREIGN PATENT DOCUMENTS

| | | | |
|---|---|---|---|
| EP | 0611618 | A1 | 8/1994 |
| GB | 2109723 | A | 6/1983 |

(Continued)

OTHER PUBLICATIONS

International Search Report and Written Opinion issued in Application No. PCT/US2018/060995 dated Jan. 25, 2019 (10 pages).

(Continued)

*Primary Examiner* — Kevin P Kerns
*Assistant Examiner* — Steven S Ha
(74) *Attorney, Agent, or Firm* — Kilpatrick Townsend & Stockton LLP

(57) ABSTRACT

Automated processes and systems dynamically control the delivery rate of molten metal to a mold during a casting process. Such automated processes and systems can include automatically controlling a flow control device (such as a control pin) during a first phase of casting to modulate molten metal flow or flow rate, moving the flow control device in a transition time between the first phase and a second phase toward a substitute flow control device position determined based on a difference between a first projected flow rate of the first phase and a second projected flow rate of the second phase, and resuming automatic control of the flow control device during the second phase based on the detected metal level and the metal level setpoint. Overshoot and/or undershoot can additionally or alternatively be mitigated by translating the mold or altering the cast speed.

20 Claims, 5 Drawing Sheets

(56) References Cited

U.S. PATENT DOCUMENTS

| | | | |
|---|---|---|---|
| 4,583,717 | A | 4/1986 | Hasegawa et al. |
| 4,774,999 | A | 10/1988 | Kraus |
| 5,119,866 | A | 6/1992 | Mihara |
| 5,298,887 | A | 3/1994 | Pepping |
| 5,311,924 | A | 5/1994 | Asano et al. |
| 5,316,071 | A | 5/1994 | Skinner et al. |
| 5,339,885 | A | 8/1994 | Sinden et al. |
| 5,490,554 | A | 2/1996 | Moritz |
| 5,526,870 | A | 6/1996 | Odegard et al. |
| 5,678,623 | A | 10/1997 | Steen et al. |
| 6,216,765 | B1 | 4/2001 | Tseng et al. |
| 6,289,971 | B1 | 9/2001 | Kagawa |
| 6,308,767 | B1 | 10/2001 | Hugo et al. |
| 6,460,595 | B1 | 10/2002 | Benz et al. |
| 6,631,753 | B1 | 10/2003 | Carter, Jr. et al. |
| 6,779,588 | B1 | 8/2004 | Good et al. |
| 6,851,587 | B1 | 2/2005 | Tseng |
| 7,143,809 | B1 | 12/2006 | Johansen et al. |
| 7,617,864 | B2 | 11/2009 | Gallerneault |
| 7,789,124 | B2 | 9/2010 | Gallerneault |
| 7,882,887 | B2 | 2/2011 | Wagstaff et al. |
| 8,096,344 | B2 | 1/2012 | Wagstaff et al. |
| 8,312,915 | B2 | 11/2012 | Anderson et al. |
| 8,336,603 | B2 | 12/2012 | Bischoff et al. |
| 8,347,949 | B2 | 1/2013 | Anderson et al. |
| 8,415,025 | B2 | 4/2013 | Anderson et al. |
| 9,192,988 | B2 | 11/2015 | Wagstaff et al. |
| 9,314,840 | B2 | 4/2016 | Wagstaff et al. |
| 2005/0263260 | A1 | 12/2005 | Smith |
| 2010/0032455 | A1 | 2/2010 | Cooper et al. |
| 2014/0262119 | A1 | 9/2014 | Wagstaff et al. |

FOREIGN PATENT DOCUMENTS

| | | | |
|---|---|---|---|
| JP | S59-35867 | A | 2/1984 |
| JP | S59-78763 | A | 5/1984 |
| JP | H01-309770 | A | 12/1989 |
| JP | H02-160154 | A | 6/1990 |
| JP | H02-211957 | A | 8/1990 |
| JP | H03174959 | A | 7/1991 |
| JP | H04-118163 | A | 4/1992 |
| JP | H07-16713 | A | 1/1995 |
| JP | H09-1304 | A | 1/1997 |
| JP | H10-61602 | A | 3/1998 |
| JP | 2000-326056 | A | 11/2000 |
| JP | 2004-283869 | A | 10/2004 |
| JP | 2008-525200 | A | 7/2008 |
| JP | 2013-071144 | A | 4/2013 |
| JP | 2016501339 | A | 1/2016 |
| KR | 10-2013-0012451 | A | 2/2013 |
| RU | 2351431 | C2 | 4/2009 |
| SU | 1092825 | A1 | 5/1999 |
| WO | 97/14521 | A1 | 4/1997 |
| WO | 2012083452 | A1 | 6/2012 |
| WO | 2014164911 | A1 | 10/2014 |

OTHER PUBLICATIONS

Japanese Patent Application No. 2019-540332, "Office Action", dated Jan. 7, 2020, along with an English translation, 7 pages.

Russian Patent Application No. 2019120350, "Office Action", dated Dec. 4, 2019, along with an English translation, 18 pages.

METAL LEVEL OVERSHOOT OR UNDERSHOOT MITIGATION AT TRANSITION OF FLOW RATE DEMAND

CROSS-REFERENCE TO RELATED APPLICATIONS

This application claims the benefit of U.S. Provisional Application Nos. 62/586,270, filed Nov. 15, 2017, and 62/687,379, filed Jun. 20, 2018, which are incorporated herein by reference in their entireties.

FIELD OF THE INVENTION

This application relates to automated processes and systems that dynamically control the rate of delivery of molten metal to a mold during a casting process.

BACKGROUND

When producing an ingot cast, such as in an aluminum casting process, control of metal flow into the mold is an important factor. For example, at the extremes, excessive metal flow could cause a mold to overflow or otherwise exceed appropriate boundaries and damage other equipment, while inadequate flow could allow metal to cool and solidify before reaching boundaries of the mold and result in ingots having undesirable shapes or other negative characteristics.

Appropriate flow control can be challenging to maintain due to fluctuations that can occur in flow behavior even when other variables are steadily maintained and not changed. Take for example, a conduit that can be closed to different degrees by moving a tapered pin to be closer or farther from engagement with a similarly tapered opening of the conduit. Even if the pin is held at a constant position, flow rate out through the partially obstructed opening may vary according to a number of factors, such as an amount and weight of molten metal behind the pin in the mold, composition of the flowing metal, temperature, etc.

Often, such fluctuations are accounted for by automated algorithms that detect a metal level in the mold, compare the detected level to a target level (e.g., setpoint), and respond by altering a pin position (or other setting of some other flow control device) to address discrepancies between the detected and target levels. For example, the pin may be opened a small amount in response to determining that the detected level is slightly lower than the setpoint, opened a larger amount in response to a greater determined deficiency, and moved incrementally in a closing direction upon registering that the detected level is above the setpoint.

Although such algorithms can provide useful control for mitigating level deviation, flow control issues can still arise. For example, in operation of such algorithms, the actual metal level may "overshoot" or "undershoot" the setpoint by a significant amount when flow rate requirements change suddenly. Such overshoot or undershoot may negatively affect process control, cause the cast to abort (e.g., due to the detected level falling outside approved parameters), or otherwise negatively affect casting processes.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

Certain examples herein address overshoot or undershoot concerns by pre-emptively calculating a flow control device position at which the pin (or other flow control device) would be expected to provide an appropriate flow rate for an upcoming phase (e.g., based on some linear equations relating the expected flow rate of one phase to that of an immediately following phase) and briefly interrupting normal automatic control to substitute in the calculated flow control device position. In effect, this can place the pin (or other flow control device) roughly in a suitable position when the change occurs so that less overshoot or undershoot is experienced than if the automatic algorithm were instead permitted to run without such brief intervention. In some examples, overshoot or undershoot concerns can additionally or alternatively be addressed by vertically translating the mold and/or by altering a casting speed, e.g., either of which may adjust how quickly or slowly space becomes available in the mold to accommodate changes in flow rates that might otherwise cause overshoot or undershoot.

In various examples, a method of delivering molten metal in a casting process is provided. The method includes providing a mold apparatus. The mold apparatus includes a mold; a conduit configured to deliver the molten metal to the mold, where the conduit is controllably occluded by a control pin; a positioner coupled to the control pin; a level sensor configured to sense a level of the molten metal in the mold; and a controller coupled with the positioner and the level sensor. The method further includes providing input to the controller in the form of a metal level setpoint that is variable over time according to a casting recipe having at least a first phase, a transition point, and a second phase. The first phase has a first projected flow rate that differs from a second projected flow rate of the second phase. The transition point corresponds to a point in time at which the first phase ends and the second phase begins. The method further includes providing input to the controller from the level sensor in the form of a detected metal level. Additionally, for the first phase, the method includes providing from the controller to the positioner a first pin position output command signal that is variable over time and includes a first varying pin position determined based on the detected metal level and the metal level setpoint for automatically controlling the control pin during the first phase to modulate flow or flow rate of the molten metal through the conduit such that the level of molten metal in the mold remains in a molten metal level range that is about the metal level setpoint. The method also includes determining a substitute pin position value based on a difference between the first projected flow rate of the first phase and the second projected flow rate of the second phase. The method additionally includes providing from the controller to the positioner the substitute pin position value in lieu of the first varying pin position at the transition point. For the second phase, the method also includes, providing from the controller to the positioner a second pin position output command signal that is variable over time and includes a second varying pin position determined based on the detected metal level and the metal level setpoint for automatically controlling the control pin during the second phase.

In various examples, a mold apparatus for casting metal is provided. The mold apparatus includes a mold; a conduit configured to deliver molten metal to the mold, where the conduit is controllably occluded by a flow control device; a positioner coupled to the flow control device; a level sensor configured to sense a level of the molten metal in the mold; and a controller coupled with the positioner and the level sensor. The controller includes a processor adapted to execute code stored on a non-transitory computer-readable medium in a memory of the controller. The controller is programmed by the code to perform various functions. For example, the controller is programmed by the code to accept or determine input in the form of a metal level setpoint that is variable over time according to a casting recipe having at least a first phase, a transition time, and a second phase, where the first phase has a first projected flow rate that differs from a second projected flow rate of the second phase, and where the transition time corresponds to a time between an end of the first phase and a beginning of the second phase. The controller is also programmed by the code to accept input from the level sensor in the form of a detected metal level. The controller is also programmed by the code to provide to the positioner, a first command signal that automatically controls the flow control device during the first phase to modulate flow or flow rate of molten metal through the conduit based on the detected metal level and the metal level setpoint such that the level of molten metal in the mold remains in a molten metal level range that is about the metal level setpoint. The controller is programmed by the code to also provide to the positioner, a transition command signal that moves the flow control device in the transition time toward a substitute flow control device position determined based on a difference between the first projected flow rate of the first phase and the second projected flow rate of the second phase. The controller also is programmed by the code to provide to the positioner, a second command signal that automatically controls the flow control device during the second phase based on the detected metal level and the metal level setpoint.

In various examples, a method of delivering molten metal in a casting process is provided. The method includes accepting or determining, by a controller, input in the form of a metal level setpoint that is variable over time according to a casting recipe having at least a first phase, a transition time, and a second phase, where the first phase has a first projected flow rate that differs from a second projected flow rate of the second phase, and where the transition time corresponds to a time between an end of the first phase and a beginning of the second phase. The method also includes accepting, by the controller, input in the form of a detected metal level from a level sensor coupled with the controller and configured to sense a level of the molten metal in a mold. The method additionally includes providing a first command signal from the controller to a positioner coupled to flow control device controllably occluding a conduit configured to deliver the molten metal to the mold, the first command signal being configured to automatically control the flow control device during the first phase to modulate flow or flow rate of the molten metal through the conduit based on the detected metal level and the metal level setpoint such that the level of molten metal in the mold remains in a molten metal level range that is about the metal level setpoint. The method further includes providing from the controller to the positioner a transition command signal that moves the flow control device in the transition time toward a substitute flow control device position determined based on a difference between the first projected flow rate of the first phase and the second projected flow rate of the second phase. Furthermore, the method includes providing from the controller to the positioner, a second command signal that automatically controls the flow control device during the second phase based on the detected metal level and the metal level setpoint.

In various examples, an apparatus for casting metal is provided. The apparatus includes a mold; a conduit configured to deliver molten metal to the mold, where the conduit is controllably occluded by a flow control device; a positioner coupled to the flow control device; a level sensor configured to sense a level of the molten metal in the mold; and a controller. The controller includes a processor adapted to execute code stored on a non-transitory computer-readable medium in a memory of the controller. The controller is programmed by the code to perform various functions. For example, the controller is programmed by the code to accept or determine input in the form of a metal level setpoint that is variable over time according to a casting recipe having at least a first phase, a transition time, and a second phase, where the first phase has a first projected flow rate that differs from a second projected flow rate of the second phase, and where the transition time corresponds to a time between an end of the first phase and a beginning of the second phase. The controller is also programmed by the code to accept input from the level sensor in the form of a detected metal level. The controller is also programmed by the code to provide a transition command signal configured to achieve a goal of reducing or eliminating an amount of undershoot or overshoot related to the transition time. The transition command signal is configured to achieve the goal by causing at least one of: (A) movement of the flow control device in the transition time toward a substitute flow control device position determined based on a difference between the first projected flow rate of the first phase and the second projected flow rate of the second phase; (B) translation of the mold to change a height between the mold and the conduit; or (C) alteration of a casting speed to differ at or around the transition time and to differ from a casting speed present during the second phase.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
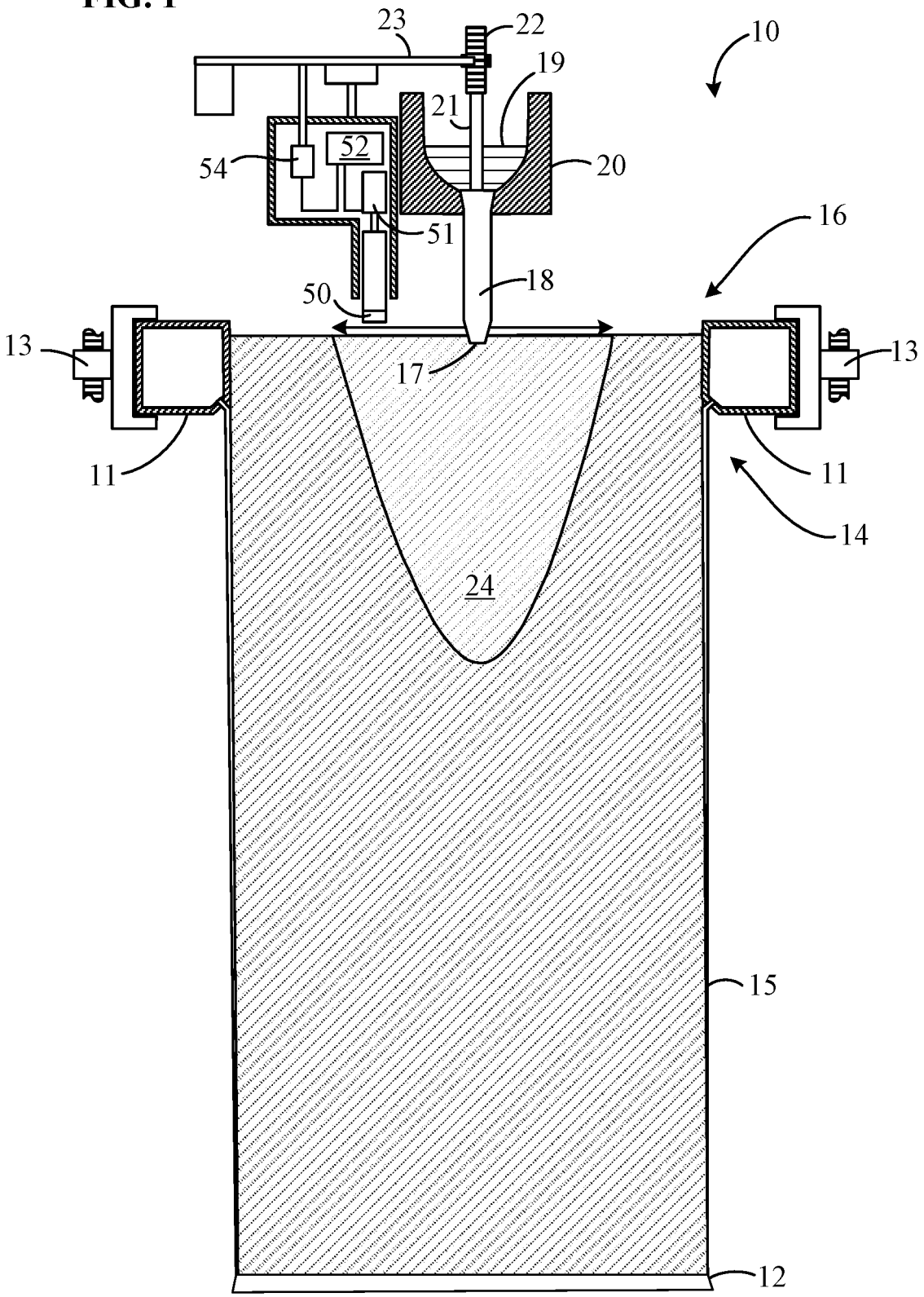
FIG. 1 is a schematic representation of a direct chill casting apparatus as it appears toward the end of a casting operation, according to various examples.

FIG. 1 is a simplified schematic vertical cross-section of an upright direct chill casting apparatus 10, at the end of a casting operation. In some cases, the disclosed processes and systems can be used with a continuous casting process. With reference to FIG. 1, the apparatus includes a direct chill casting mold 11, such as of rectangular annular form in top plan view but optionally circular or of other shape, and a bottom block 12 that is moved gradually vertically downwardly by suitable support means (not shown) during the casting operation from an upper position initially closing and sealing a lower end 14 of the mold 11 to a lower position (as shown) supporting a cast ingot 15. The ingot is produced in the casting operation by introducing molten metal into an upper end 16 of the mold through a vertical hollow spout 18 or similar metal feed mechanism while the bottom block 12 is slowly lowered. Molten metal 19 is supplied to the spout 18 from a metal melting furnace (not shown) via a launder 20 or other device forming a horizontal channel above the mold 11.

The spout 18 encircles a lower end of a control pin 21 that regulates and can terminate the flow of molten metal through the spout. In one example, a plug such as a ceramic plug forming a distal end of the pin 21 is received within a tapered interior channel of the spout 18 such that when the pin 21 is raised, the area between the plug and the open end of the spout 18 increases, thus allowing molten metal to flow around the plug and out the lower tip 17 of the spout 18. Thus, flow and rate of flow of molten metal may be controlled precisely by appropriately raising or lowering the control pin 21. Any desirable structure or mechanism may be used for control of flow of molten metal into the mold. For convenience, the terms "conduit," "control pin" and "command signals" that control position of the control pin relative to the conduit are utilized in this document to refer to any mechanism or structure that is capable of regulating flow or flow rate of molten metal into the mold by virtue of command signals from a controller and are not limited to a pin/control pin; accordingly, reference in this document (including the claims) to providing command signals to a control pin positioner to regulate molten metal flow or flow rate into a mold will be understood to mean providing command signals to an actuator of whatever type to control flow or flow rate of molten metal into the mold in whatever manner and using whatever structure or mechanism.

In the structure shown in FIG. 1, the control pin 21 has an upper end 22 extending upwardly from the spout 18. The upper end 22 is pivotally attached to a control arm 23 that raises or lowers the control pin 21 as appropriate to regulate or terminate the flow of molten metal through the spout 18. For casting, the launder 20 and the spout 18 are lowered sufficiently to allow a lower tip 17 of the spout 18 to dip into molten metal forming a pool 24 in the embryonic ingot to avoid splashing of and turbulence in the molten metal. This minimizes oxide formation and introduces fresh molten metal into the mold 11. The tip may also be provided with a distribution bag (not shown) in the form of a metal mesh fabric that helps to distribute and filter the molten metal as it enters the mold 11. At the completion of casting, the control pin 21 is moved to a lower position where it blocks the spout 18 and completely prevents molten metal from passing through the spout 18, thereby terminating the molten metal flow into the mold 11. At this time, the bottom block 12 no longer descends, or descends further only by a small amount, and the newly-cast ingot 15 remains in place supported by the bottom block 12 with its upper end still in the mold 11. The launder 20 is raised at this time to withdraw the spout 18 from the head of the ingot.

Apparatus 10 can include a metal level sensor 50. In some cases, the structure and operation of the metal level sensor 50 is conventional. Other non-limiting options for the sensor 50 may include a float and transducer, a laser sensor, or another type of fixed or movable fluid level sensor having desired properties for accommodating molten metal. During the cavity filling operations, the information obtained from the sensor 50 can be fed to a controller 52. The controller 52 can use the data obtained from the sensor 50 among other data to determine when the control pin 21 is to be raised and/or lowered by an actuator 54 so that metal may flow into the mold 11 to fill a partial cavity, i.e. when the depth of the predetermined cavity reaches a predetermined limit. Thus, the sensor 50 and the actuator 54 are coupled with the controller 52, as shown in FIG. 1, to allow information from the sensor 50 to be used in connection with positioning the control pin 21 under control of the actuator 54 and thereby control flow and/or flow rate of molten metal into the mold 11. In various examples, the controller 52 is a proportional-integral-derivative (PID) controller, which may be a conventional PID controller, or a PID controller that is implemented as desired digitally and programmably.

Figure 2:
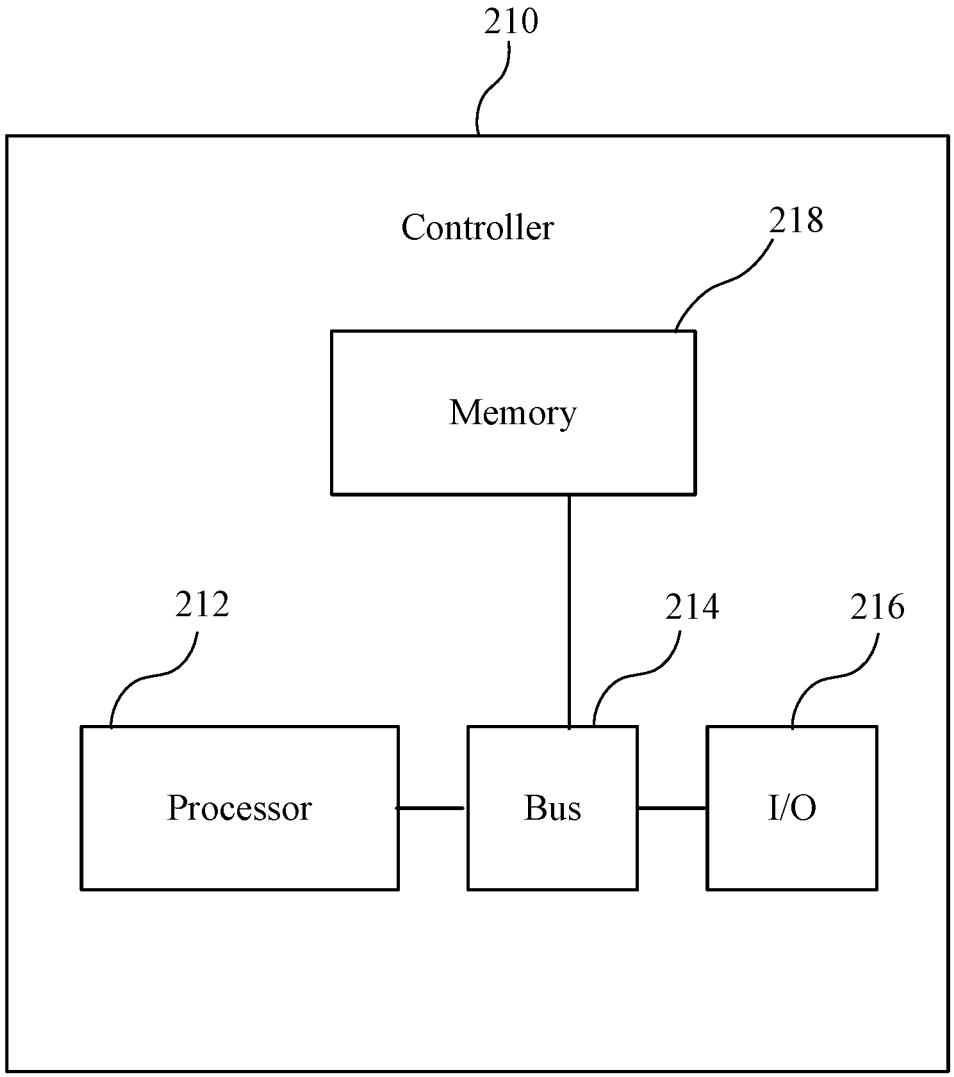
FIG. 2 is a schematic representation of a digitally and programmably implemented controller according to various examples.

FIG. 2 is an example of a controller 210 that is implemented digitally and programmably using conventional computer components, and that may be used in connection with certain examples (e.g., including equipment such as shown in FIG. 1) to carry out processes of such examples. The controller 210 includes a processor 212 that can execute code stored on a tangible computer-readable medium in a memory 218 (or elsewhere such as portable media, on a server or in the cloud among other media) to cause the controller 210 to receive and process data and to perform actions and/or control components of equipment such as shown in FIG. 1. The controller 210 may be any device that can process data and execute code that is a set of instructions to perform actions such as to control industrial equipment. As non-limiting examples, the controller 210 can take the form of a digitally and programmably implemented PID controller, a programmable logic controller, a microprocessor, a server, a desktop or laptop personal computer, a handheld computing device, and a mobile device.

Examples of the processor 212 include any desired processing circuitry, an application-specific integrated circuit (ASIC), programmable logic, a state machine, or other suitable circuitry. The processor 212 may include one processor or any number of processors. The processor 212 can access code stored in the memory 218 via a bus 214. The memory 218 may be any non-transitory computer-readable medium configured for tangibly embodying code and can include electronic, magnetic, or optical devices. Examples of the memory 218 include random access memory (RAM), read-only memory (ROM), flash memory, a floppy disk, compact disc, digital video device, magnetic disk, an ASIC, a configured processor, or other storage device.

Instructions can be stored in the memory 218 or in the processor 212 as executable code. The instructions can include processor-specific instructions generated by a compiler and/or an interpreter from code written in any suitable computer-programming language. The instructions can take the form of an application that includes a series of setpoints, parameters for the casting process, and programmed steps which, when executed by the processor 212, allow the controller 210 to control flow of metal into a mold, such as by using the molten metal level feedback information from the sensor 50 in combination with metal level setpoints and other casting-related parameters which may be entered into the controller 210 to control the actuator 54 and thereby the position of the pin 21 in the spout 18 in the apparatus shown in FIG. 1 for controlling flow and/or flow rate of molten metal into the mold 11.

The controller 210 shown in FIG. 2 includes an input/output (I/O) interface 216 through which the controller 210 can communicate with devices and systems external to the controller 210, including components such as the sensor 50, the actuator 54 and/or other mold apparatus components. The interface 216 can also if desired receive input data from other external sources. Such sources can include control panels, other human/machine interfaces, computers, servers or other equipment that can, for example, send instructions and parameters to the controller 210 to control its performance and operation; store and facilitate programming of applications that allow the controller 210 to execute instructions in those applications to control flow of metal into a mold such as in connection with the processes of certain examples disclosed herein; and other sources of data necessary or useful for the controller 210 in carrying out its functions to control operation of the mold, such as mold 11 of FIG. 1. Such data can be communicated to the I/O interface 216 via a network, hardwire, wirelessly, via bus, or as otherwise desired.

Figure 3:
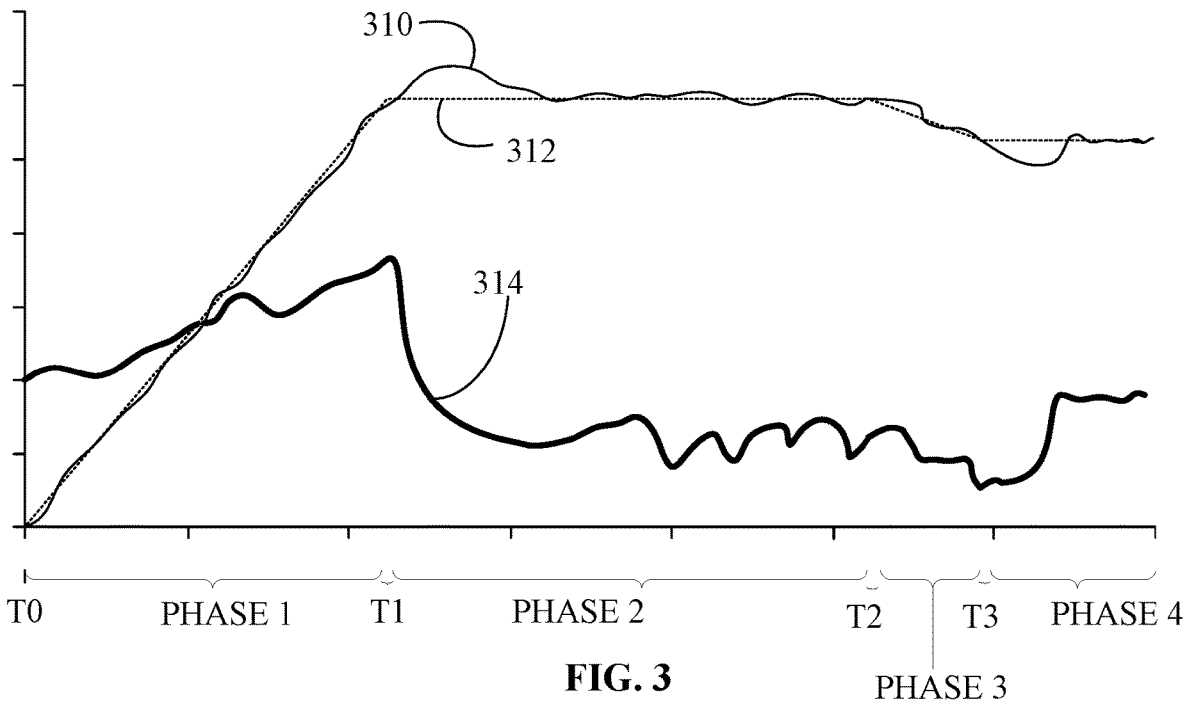
FIG. 3 (prior art)
FIG. 3 is a metal level control trend chart in connection with a process conducted according to conventional control processes.

FIG. 3 shows a metal level control trend chart for one direct chill aluminum casting process conducted according to a conventional control process. The chart shows actual metal level (numeral 310), metal level setpoint (312), and the command to the pin positioner (314) (e.g., from the PID algorithm in the controller 52). The actual metal level 310 and the metal level setpoint 312 share the same vertical scale in this graphic, while the command to the pin positioner 314 is on a different vertical scale but overlaid on the same horizontal time scale for ease of viewing.

In the example shown in FIG. 3, the metal level setpoint 312 is variable over time according to a casting recipe. The casting recipe is shown having four phases, although any other number of two or more phases could be utilized. The phases correspond to portions of the cast process that have differing flow rate demands. For example, with reference to both FIG. 1 and FIG. 3, Phase 1 may correspond to a period of time T0 from the beginning of cast when the molten metal begins to fill the mold 11 until the platen or bottom block 12 begins to move down at T1, while Phase 2 may correspond to a period of time in which the platen or bottom block 12 is moving steadily downward to form the ingot. In such a situation, the metal flow rate applicable in Phase 1 before the bottom block 12 begins to move down may be higher than the metal flow rate applicable in Phase 2 after the bottom block 12 begins to move down. As a result, an excess of metal may be introduced at the transition between the two phases and cause an appreciable difference between the actual metal level 310 and the metal level setpoint 312, such as shown in FIG. 3 following transition point or time T1, where an overshoot bulge in the actual metal level 310 up over metal level setpoint 312 may be seen before the PID or other algorithm sufficiently responds to adjust the pin position sufficiently to cause the levels to converge once again. Such an overshoot may in some cases result in a deviation from setpoint that is large enough to trigger an abort of the entire cast.

Another example of overshoot may be appreciated at T2 between Phases 2 and 3 in FIG. 3. Phase 3 is shown as a ramp down of metal level setpoint 312, for example, as may be done at a later stage in the cast, such as to run at a lower head level for obtaining an improved ingot quality. Accordingly, the metal flow rate applicable in Phase 2 as the metal level is maintained fairly stably may be higher than the metal flow rate applicable in Phase 3 as the metal level is being tapered down. As a result, an excess of metal may be introduced at the transition between the two phases and cause an appreciable difference of the actual metal level 310 surging over the metal level setpoint 312, such as shown in FIG. 3 following transition point or time T2, where the actual metal level 310 forms an overshoot bulge (less pronounced than that at T1) up over metal level setpoint 312 before the PID or other algorithm sufficiently responds to adjust the pin position sufficiently to cause the levels to converge once again.

An example of undershoot may be appreciated at T3 in FIG. 3. Phase 4 is shown as another stage in which the metal level is maintained following the ramp down of Phase 3, such as to maintain the head level at a sufficient ongoing level to maintain contact with the mold 11 that will provide sufficient cooling and solidifying of molten metal in the pool 24 to prevent bleed out of the molten metal along bottom edges of the mold 11. Accordingly, the metal flow rate applicable in Phase 3 as the metal level is being tapered down may be lower than the metal flow rate applicable in Phase 4 as the metal level is levelled off. As a result, an insufficient amount of metal may be introduced at the transition between the two phases, Phase 3 and Phase 4, and cause an appreciable difference of the actual metal level 310 falling under the metal level setpoint 312, such as shown in FIG. 3 following transition point or time T3, where an undershoot bulge in the actual metal level 310 below the metal level setpoint 312 may be seen before the PID or other algorithm sufficiently responds to adjust the pin position sufficiently to cause the levels to converge once again. Undershoot might also occur in a scenario where the metal level setpoint from a steady level is tapered upward (not shown), since this would also result in an earlier phase having a lower metal flow rate demand than a phase immediately following.

Figure 4:
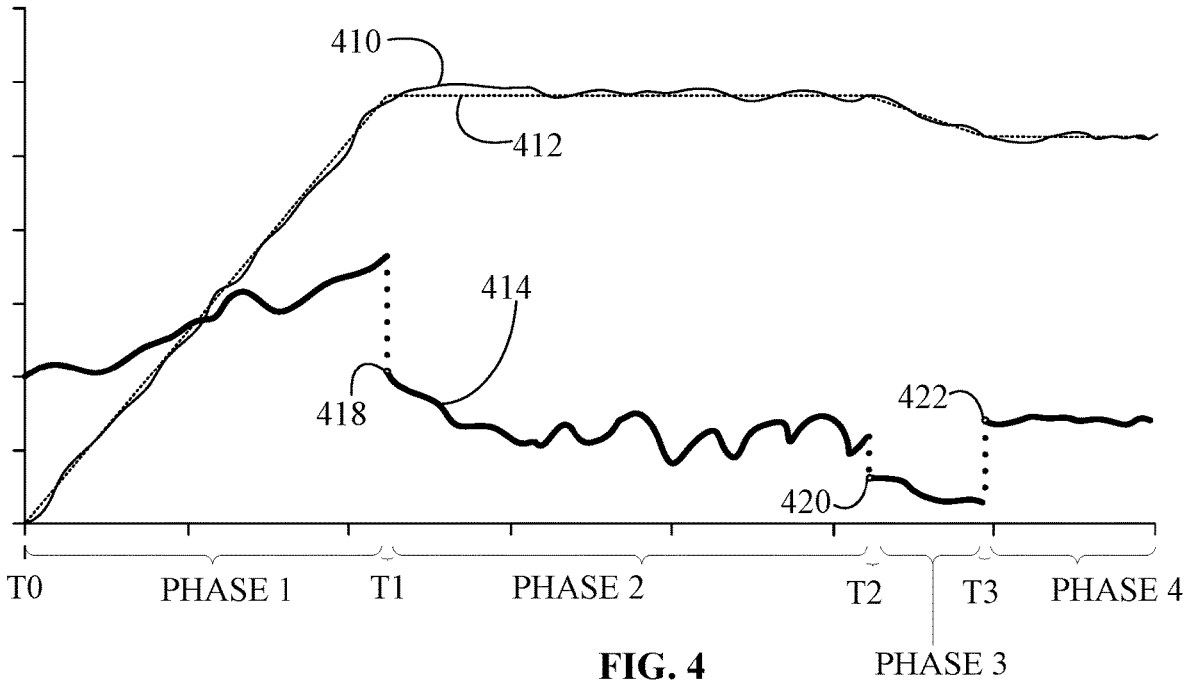
FIG. 4 is a metal level control trend chart in connection with a process conducted according to various examples.

FIG. 4, in contrast, is a metal level control trend in connection with a process conducted according to various examples of the present disclosure. Similar to FIG. 3, FIG. 4 shows actual metal level (numeral 410), metal level setpoint (412), and the command to the pin positioner (414)

(e.g., from the PID algorithm in the controller 52). As may be appreciated, the metal level setpoint (412) shown in FIG. 4 follows the same casting recipe as the metal level setpoint 312 in FIG. 3, although the command to the pin positioner 414 is implemented according to a different technique that minimizes overshoot and/or undershoot at transitions between phases.

As the casting recipe is predetermined, it can be utilized in a predictive manner to mitigate undershoot or overshoot that might otherwise occur. For example, at transition point or time T1, rather than allowing the automatic operation of the PID or other algorithm to run continuously and eventually cause convergence after a significant overshoot as in FIG. 3, a substitute pin position can be provided (e.g., by the controller 52) for the transition point or time T1. In some cases, this may correspond to substituting a pin position in lieu of what would have been provided as a result of a specific single scan or calculation of the PID algorithm. For example, a typical cycle time for a PID algorithm update may be every 0.1 to 0.5 seconds. As such, in various examples, the PID or other automatic control algorithm may be interrupted for a similarly brief window.

The value of the substituted pin position may correspond to a predicted value of the metal flow rate demand that will be needed in the next phase. In some examples, a linear relationship between projected metal flow rate demands of the successive Phases may be utilized to obtain the value of the substituted pin position. For example, if the expected flow rate demand for Phase 2 is 25% lower than the expected flow rate demand for Phase 1, the value of the substitute pin position may be selected to be 25% lower than a value of the pin position at the end of Phase 1. Graphically, in FIG. 4, such a substitution is represented at T1 as a new reduced pin position being introduced at 418 in substitution for the pin position that would have otherwise been introduced at the end of Phase 1. In some examples, the substitute pin position may be calculated based at least in part on a starting point of a prediction about what the pin position is expected to be at the end of Phase 1. Additionally or alternatively, the substitute pin position may be calculated based at least in part on an actual pin position detected at or near the end of Phase 1.

Following the introduction of the substituted pin position 418 at T1, the PID or other algorithm may resume for Phase 2. The algorithm may proceed in a "bumpless" fashion and use the substituted pin position at 418 as a reference point from which to determine subsequent pin positions for the command signal to the actuator 54. As a result of introducing the substituted pin position, the PID or other algorithm may accordingly respond to the transition between phases much more quickly than in the arrangement shown in FIG. 3, and reduce or eliminate overshoot as a result, e.g., as may be appreciated by comparing the actual metal line 310 following T1 in FIG. 3 (e.g., with its substantial overshoot bulge) with the actual metal line 410 following T1 in FIG. 4 (e.g., in which overshoot is comparatively drastically reduced and/or eliminated).

Similar substitutions 420 and 422 are shown at T2 and T3 in FIG. 4. The substitution 420 is a lowering of the pin position similar to, but smaller than, that of substitute pin position 418, as T2 involves a less drastic case of a risk of overshoot from a former phase having a higher flow rate demand than that of a latter phase. The substitute pin position 422 in contrast corresponds to a raising of the pin position, as T3 involves a case of a risk of undershoot from a former phase having a lower flow rate demand than that of a latter phase. As a result of introducing either or both of the respective substitutions 420 and 422, the PID or other algorithm may accordingly respond to respective transitions between phases much more quickly than in the arrangement shown in FIG. 3, and reduce or eliminate respective overshoot and/or undershoot as a result, e.g., as may be appreciated by comparing the actual metal line 310 following T2 in FIG. 3 (e.g., with its gradual yet significant overshoot bulge) with the actual metal line 410 following T2 in FIG. 4 (e.g., in which overshoot is comparatively drastically reduced and/or eliminated) and/or by comparing the actual metal line 310 following T3 in FIG. 3 (e.g., with its substantial undershoot bulge) with the actual metal line 410 following T3 in FIG. 4 (e.g., in which undershoot is comparatively drastically reduced and/or eliminated).

Although FIGS. 3-4 relate to one process according to a particular casting recipe, it is not necessarily representative of certain other examples. A process more generally is described with respect to FIG. 5.

Figure 5:
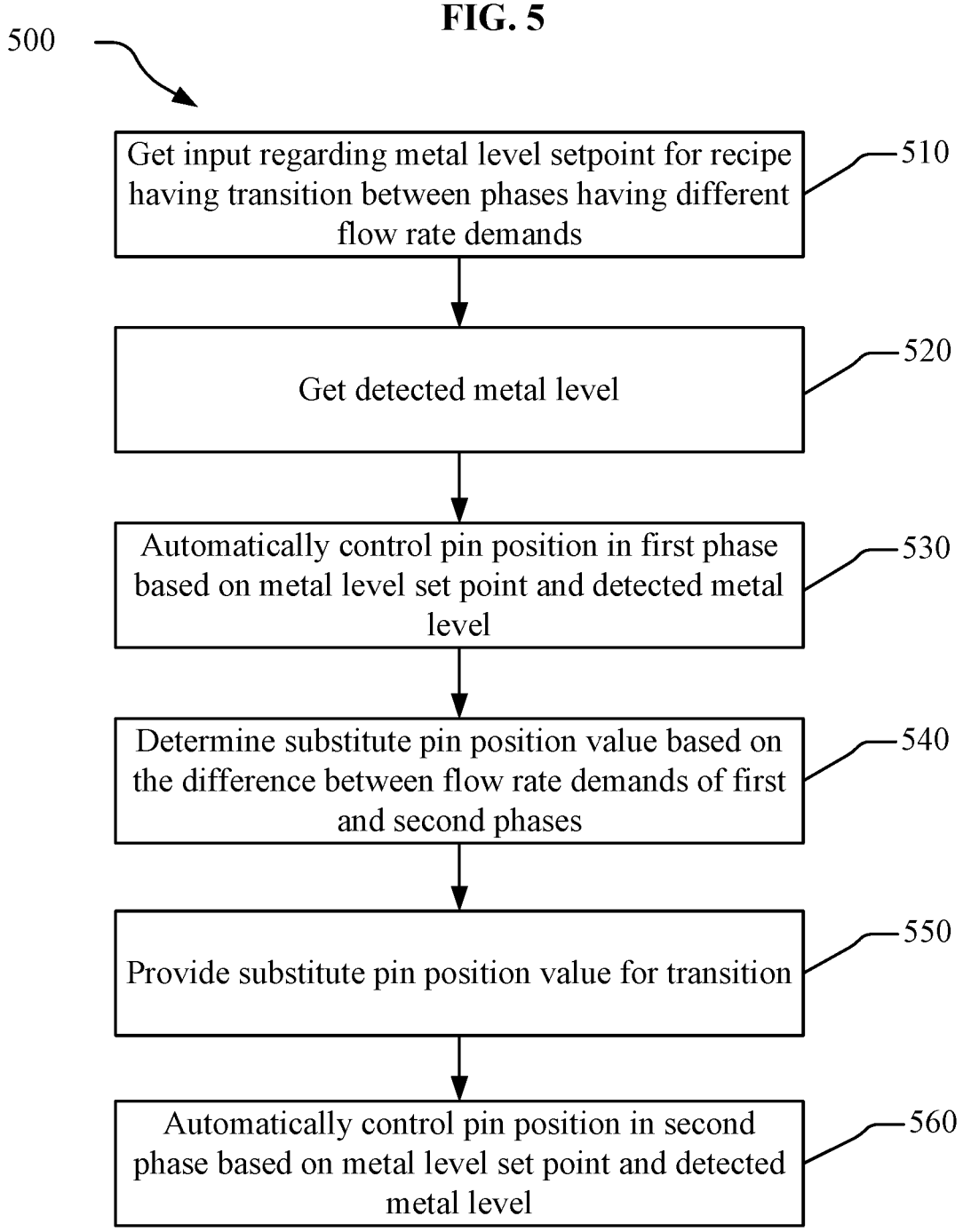
FIG. 5 is a flow chart illustrating a method of metal level delivery control according to various examples.

FIG. 5 is a flow chart illustrating a method 500 of metal level delivery control according to various examples. Various operations in the method 500 can be performed by the controller 52 and/or other elements described above.

At 510, the method 500 includes getting input regarding a metal level setpoint for a casting recipe having a transition between phases with different flow rate demands. The metal level setpoint can be variable over time according to the casting recipe. The phases having different flow rate demands may correspond to the first phase having a first projected flow rate that differs from a second projected flow rate of the second phase. For clarity, although the terms "first phase" and "second phase" as used herein may in some examples appropriately respectively refer to Phase 1 and Phase 2 described in FIGS. 3-4, the terms are not so limited and may refer to any two phases having differing flow rates and separated by a transition, including, but not limited to, other examples such as in which the first phase is Phase 2 and the second phase is Phase 3, or in which the first phase is Phase 3 and the second phase is Phase 4, or in which the first phase is one phase not specifically shown in FIGS. 3-4 and the second phase is another phase not specifically shown in FIGS. 3-4, and so on. The recipe may additionally or alternatively include parameters such as water flow or cast speed. The transition may correspond to a discrete point of time (e.g., a point at which the first phase ends and the second phase begins), or a particular range of time (e.g., a time between an end of the first phase and a beginning of the second phase).

At 520, the method 500 includes getting a detected metal level. For example, this may correspond to getting input in the form of a detected metal level from a level sensor coupled with the controller and configured to sense the level of molten metal in a mold, such as that described above with respect to FIG. 1. In some examples, the detected metal level from a metal level sensor is used by the PID algorithm in an iterative process that involves re-calculating a pin position set point every 0.1 seconds, 0.5 seconds, or according to another interval.

At 530, the method 500 includes automatically controlling a pin position (or other adjustment of another flow control device) in the first phase based on metal level set point and detected metal level. This may correspond to controlling the pin position according to a PID or other algorithm.

At 540, the method 500 includes determining a substitute pin position value (or other adjustment of another flow control device) based on the difference between flow rate demands of the first and second phases. In some examples, this may include determining a difference value between the first projected flow rate of the first phase and the second projected flow rate of the second phase, and then determining the substitute pin position value by modifying a pin position at or near the end of the first phase according to a linear relationship with the difference value. In some examples, determining the substitute pin position value includes determining a percentage difference between the first projected flow rate of the first phase and the second projected flow rate of the second phase, and then modifying a pin position at or near the end of the first phase by that percentage difference to obtain the substitute pin position value. In some examples, the flow rate may be determined according to the following formula: Flow rate=[Cast Speed+Metal Level Ramp Rate]×Mold Surface Area, for example, where flow rate is in cubic millimeters per minute ($mm^3$/min), cast speed and metal level ramp rate are in millimeters per minute (mm/min), and mold surface area is in square millimeters ($mm^2$).

At 550, the method 500 includes providing the substitute pin position value for the transition. In some examples, this may include substituting for a single pin position outputted in the command signal as a result of a single scan from a metal level sensor. In some examples, the substitute pin position value may be introduced in lieu of multiple values that would have been generated based on multiple scans of a metal level sensor. In some examples, the substitute pin position value may be introduced for a particular amount of time, such as for the duration of a single or multiple scans, or for a particular duration of time corresponding to a maximum amount of time that it is desired or permissible to interrupt automatic control by the PID or other algorithm without negatively affecting characteristics or parameters of the ingot and/or casting process. In some examples, the substitute pin position value may be introduced via a transition command signal that moves the control pin in the transition time toward the substitute pin position. For example, automatic control based on the detected metal level and the metal level setpoint may be disrupted for less than 0.5 seconds by providing the substitute pin position value at the transition point.

Moreover, the substitute pin position may correspond to a value that is higher or lower than a projected or detected pin position value at or near and end of the first phase. In some examples, the first projected flow rate of the first phase is greater than the second projected flow rate of the second phase. In such cases, providing the substitute pin position value for the pin position at the transition point may mitigate overshoot. In some examples, the first projected flow rate of the first phase is less than the second projected flow rate of the second phase. In such cases, providing the substitute pin position value for the pin position at the transition point may mitigate undershoot.

At 560, the method 500 includes automatically controlling the pin position in the second phase based on the metal level set point and the detected metal level. This may correspond to controlling the pin position according to a PID or other algorithm. In some examples, control may transition in a smooth or bumpless fashion in which the control continues on from the substitute pin position value, e.g., to mitigate undershoot or overshoot that might otherwise occur in the absence of temporarily interrupting the automatic algorithm to interject the substitute pin position value.

Although much of the foregoing description references techniques that involve pin position substitution to mitigate overshoot and/or undershoot, other techniques described herein similarly may be utilized to mitigate overshoot and/or undershoot. For example, these other techniques—individually or in combination with each other and/or with techniques that involve pin position substitution—may be utilized to obtain results similar to those discussed above (such as with respect to FIG. 4 and the greater conformity depicted therein between the actual metal level 410 and the metal level setpoint 412 when compared to the outcome of FIG. 3 in which effects of overshoot and/or undershoot are more readily apparent with respect to the actual metal level 310 and the metal level setpoint 312). Similar to techniques that involve substitutional pin position programming, various of these other techniques can also utilize the predetermined casting recipe in a predictive manner to mitigate undershoot or overshoot, although in some scenarios these other techniques may mitigate undershoot or overshoot without necessarily utilizing the predetermined casting recipe in a predictive manner. Although these other techniques may be practiced in conjunction with one another and/or with techniques involving substitutional pin position programming, these other techniques will initially be described individually below.

In one alternative technique, a mold position can be varied to mitigate undershoot or overshoot that might otherwise occur. This may entail raising, lowering, or other translation of the mold, such as at or near a transition point or time in the casting recipe. In many scenarios, a relatively small amount of translation may be effective to mitigate undershoot or overshoot. As an illustrative example, a translation of between 5 mm and 15 mm may mitigate undershoot or overshoot in a variety of scenarios, although use may be made of other values, including larger, smaller, and/or intervening values.

Translation of the mold may be achieved by use of suitable components. For example, referring again to FIG. 1, the mold 11 is shown coupled with a mold mover 13 capable of raising or lowering the mold 11. The mold mover 13 in FIG. 1 is depicted having a threaded shaft along which a screw actuator can move up and down to change a vertical position of the mold 11, although any other form of linear actuator or other actuator maybe utilized in addition or in substitution. Additionally, although the mold mover 13 in FIG. 1 is shown attached to a top, bottom, and lateral side of the mold 11, the mold mover 13 may include any suitable structure for coupling with or otherwise supporting any portion of the mold 11 in a manner that facilitates movement of the mold 11.

Translation of the mold 11 may change a height between the mold 11 and a portion of the conduit (e.g., launder 20) that supplies molten metal 19 relative to the mold 11. In many cases, the metal level setpoint (e.g., metal level setpoint 412 in FIG. 4) and/or the actual or detected metal level (e.g., actual metal level 410 in FIG. 4) are reckoned relative to the mold 11 (FIG. 1). Hence, for example, raising the mold 11 while a surge of molten metal is flowing into the mold 11 can cause the molten metal level in the mold 11 to remain stable (e.g., at approximately the same position relative to the mold 11) as a result of the mold 11 and molten metal level rising together relative to an absolute frame of reference.

Any suitable technique can be implemented to account for effects that movement of the mold 11 may have on other values. For example, if the metal level sensor 50 is not directly mounted to the mold 11 or is not otherwise situated to move commensurate with the movement of the mold 11, the metal level relative to the mold 11 may be calculated by taking the distance to the molten metal that is detected by such sensor and adjusting from that detected value based on information about an amount of movement of the mold 11 (e.g., information sent to or received from the mold mover 13 or some other element capable of detecting movement of the mold 11) to obtain an aggregate or overall value of metal level relative to the mold 11. Alternatively, if the metal level sensor 50 includes a float sensor or other variety of sensor directly mounted to the mold 11 or otherwise situated to move commensurate with the movement of the mold 11, intervening calculations to obtain the actual metal level relative to the mold 11 may be unnecessary or greatly simplified.

In practice, in various cases, raising the mold 11 at or around a transition time can reduce or eliminate overshoot. For example, with respect to the transition time T1 in FIG. 4, as the flow rate requirement changes in the form of a drop from a higher flow rate requirement in Phase 1 to a lower flow rate requirement in Phase 2, an excess of molten metal may be introduced above and beyond an amount needed for the lower flow rate requirement in Phase 2. Whereas such excess of molten metal could become overshoot if the mold 11 were not moved (e.g., as in FIG. 3 immediately following the start of T1), raising the mold 11 can instead cause the excess of molten metal to function to fill in space newly exposed by the raising of the mold 11. Put another way, raising the mold 11 can provide additional space for the excess of molten metal to occupy so that the molten metal level relative to the mold 11 fluctuates less than if the excess of molten metal were introduced without raising the mold 11. For example, raising the mold 11 at or near the transition time T1 may cause a result such as that shown in FIG. 4 (in which the actual metal level 410 remains fairly close to the metal level setpoint 412) rather than a result as in FIG. 3 (in which a pronounced overshoot is recognizable as the actual metal level 310 bulges substantially over the metal level setpoint 312 following T1).

In various scenarios, overshoot associated with a transition time can be mitigated by raising the mold 11 without also performing a related subsequent lowering of the mold 11. For example, the mold 11 being raised can account for the excess of molten metal from a drop in flow rate requirement from one phase to the next, such that steady operation at the lower flow rate requirement can continue with the mold 11 at the raised level.

In practice, in various cases, lowering the mold 11 at or around a transition time can reduce or eliminate undershoot. For example, with respect to the transition time T3 in FIG. 4, as the flow rate requirement changes in the form of an increase from a lower flow rate requirement in Phase 3 to a higher flow rate requirement in Phase 4, an insufficient supply of molten metal may be introduced that is not enough to meet an amount needed for the higher flow rate requirement in Phase 4. Whereas such lack of molten metal could become undershoot if the mold 11 were not moved (e.g., as in FIG. 3 immediately following the start of T3), lowering the mold 11 can instead reduce an amount of space not already occupied by metal within the mold 11 and allow the relatively smaller amount of molten metal to adequately fill that remaining space that has been newly made smaller by the lowering of the mold 11. Put another way, lowering the mold 11 can reduce an amount of space that the undersized amount of molten metal needs to occupy so that the molten metal level relative to the mold 11 fluctuates less than if the undersized amount of molten metal were introduced without lowering the mold 11. For example, lowering the mold 11 at or near the transition time T3 may cause a result such as that shown in FIG. 4 (in which the actual metal level 410 remains fairly close to the metal level setpoint 412) rather than a result as in FIG. 3 (in which a pronounced undershoot is recognizable as the actual metal level 310 bulges substantially under the metal level setpoint 312 following T3).

In various scenarios, undershoot associated with a transition time can be mitigated by lowering the mold 11 without also performing a related subsequent raising of the mold 11. For example, the mold 11 being lowered can account for the undersized amount of molten metal from a rise in flow rate requirement from one phase to the next, such that steady operation at the higher flow rate requirement can continue with the mold 11 at the lowered level.

In some aspects, the predetermined casting recipe can be utilized in a predictive manner to inform parameters of translation of the mold 11 to mitigate undershoot or overshoot. For example, a rate or amount of translation of the mold 11 to mitigate undershoot or overshoot can be determined based on a difference value between the first projected flow rate of the first phase and the second projected flow rate of the second phase. As one illustrative example, this may include determining a difference value between the first projected flow rate of the first phase and the second projected flow rate of the second phase, then using that difference value to determine a predicted volume of an excess of molten metal expected due to the transition, then determining a corresponding height that will provide that volume based on other factors such as surface area of a cross section of the mold and/or cast speed, and then using that height to inform an amount of translation. A rate of the translation may be based on cast speed, flow rate requirements, or other factors.

In some aspects, parameters of translation of the mold 11 to mitigate undershoot or overshoot may be determined without direct reliance on the predetermined casting recipe in a predictive manner. For example, in some aspects, a rate or amount of translation of the mold 11 is determined based on a difference value between the detected metal level and the metal level setpoint. As an illustrative example, a closed loop PID controller could be used to receive input in the form of metal level setpoint and actual metal level (e.g., from the metal level sensor 50) and respond by providing respective commands to the mold mover 13 for translating (e.g., raising or lowering) the mold 11 to maintain the molten metal level relative to the mold 11. Put another way, the mold 11 may be moved or translated in response to the molten metal level detected in the mold 11 so that the molten metal level is maintained within a certain range relative to the mold 11. In an illustrative example, as the overshoot was occurring, the mold would move up according to PID control, then as the overshoot peaked, the mold would then lower according to the PID control, which would all occur while the pin was controlling flow according to its PID control.

In another alternative technique, a casting speed can be altered to mitigate undershoot or overshoot that might otherwise occur. This may entail changing a rate of movement of the bottom block 12 or other structure for supporting an ingot 15 formed by the molten metal 19 delivered to the mold 11. The rate may be changed at or near a transition point or time in the casting recipe. In many scenarios, a relatively small adjustment to the casting speed with respect to the transition may be effective to mitigate undershoot or overshoot. As an illustrative example, a rate change of as low as between 5% and 50% in a transition relative to an adjoining phase may mitigate undershoot or overshoot in a variety of scenarios, although use may be made of other values, including larger, smaller, and/or intervening values.

Alteration of the casting speed relative to a transition time may be achieved by use of suitable components. For example, referring again to FIG. 1, any suitable mechanism can be used to lower the bottom block 12 at a controlled rate that may be varied according to particulars of a given casting process. The rate associated with the casting speed may correspond to a rate at which the bottom block 12 moves downward from the conduit (e.g., launder 20) that supplies molten metal 19 relative to the mold 11.

In practice, in various cases, increasing the casting speed at or around a transition time can reduce or eliminate overshoot. For example, with respect to the transition time T1 in FIG. 4, as the flow rate requirement changes in the form of a drop from a higher flow rate requirement in Phase 1 to a lower flow rate requirement in Phase 2, an excess of molten metal may be introduced above and beyond an amount needed for the lower flow rate requirement in Phase 2. Whereas such excess of molten metal could become overshoot if the casting speed were not increased at or around the transition time (e.g., as in FIG. 3 immediately following the start of T1), increasing the casting speed at or around the transition time (e.g., to exceed the casting speed of the first phase and/or the casting speed of the second phase) can instead cause the excess of molten metal to function to fill in space newly exposed as a result of the bottom block 12 moving at a faster rate. Put another way, increasing the casting speed at or around the transition time can provide additional space for the excess of molten metal to occupy so that the molten metal level relative to the mold 11 fluctuates less than if the excess of molten metal were introduced without increasing the casting speed at or around the transition time. For example, increasing the casting speed at or near the transition time T1 may cause a result such as that shown in FIG. 4 (in which the actual metal level 410 remains fairly close to the metal level setpoint 412) rather than a result as in FIG. 3 (in which a pronounced overshoot is recognizable as the actual metal level 310 bulges substantially over the metal level setpoint 312 following T1).

In various scenarios, increasing the casting speed at or near the transition time may be balanced with a related subsequent decreasing of the casting speed. For example, after the casting speed has been raised at or near the transition time, the casting speed may be subsequently lowered to converge with a casting speed dictated by the casting recipe. In an illustrative example, the casting speed may be linearly ramped from the increased level of the transition time down to the recipe setpoint. Such ramping may be performed at a suitably gentle ramp to allow automatic control (e.g., via a PID controller) to be implemented to maintain the molten metal level in the mold without overshooting.

In practice, in various cases, decreasing the casting speed at or around a transition time can reduce or eliminate undershoot. For example, with respect to the transition time T3 in FIG. 4, as the flow rate requirement changes in the form of an increase from a lower flow rate requirement in Phase 3 to a higher flow rate requirement in Phase 4, an insufficient supply of molten metal may be introduced that is not enough to meet an amount needed for the higher flow rate requirement in Phase 4. Whereas such lack of molten metal could become undershoot if the casting speed were not decreased at or around the transition time (e.g., as in FIG. 3 immediately following the start of T3), decreasing the casting speed at or around the transition time (e.g., to be less than the casting speed of the third phase and/or the casting speed of the fourth phase) can instead reduce a speed at which an amount of space not already occupied by metal within the mold 11 grows and allow the relatively smaller amount of molten metal to adequately fill that remaining space that has been made to grow more slowly by the reduction in the casting speed at or around the transition. Put another way, reducing the casting speed at or around the transition can reduce an amount of space that the undersized amount of molten metal needs to occupy so that the molten metal level relative to the mold 11 fluctuates less than if the undersized amount of molten metal were introduced without decreasing the casting speed at or around the transition. For example, decreasing the casting speed at or near the transition time T3 may cause a result such as that shown in FIG. 4 (in which the actual metal level 410 remains fairly close to the metal level setpoint 412) rather than a result as in FIG. 3 (in which a pronounced undershoot is recognizable as the actual metal level 310 bulges substantially under the metal level setpoint 312 following T3).

In various scenarios, decreasing the casting speed at or near the transition time may be balanced with a related subsequent increasing of the casting speed. For example, after the casting speed has been lowered or reduced at or near the transition time, the casting speed may be subsequently raised or increased to converge with a casting speed dictated by the casting recipe. In an illustrative example, the casting speed may be linearly ramped from the decreased level of the transition time up to the recipe setpoint. Such ramping may be performed at a suitably gentle ramp to allow automatic control (e.g., via a PID controller) to be implemented to maintain the molten metal level in the mold without undershooting.

In some aspects, the predetermined casting recipe can be utilized in a predictive manner to inform parameters of alteration of the cast speed to mitigate undershoot or overshoot. For example, an amount of alteration of the casting speed to mitigate undershoot or overshoot can be determined based on a difference value between the first projected flow rate of the first phase and the second projected flow rate of the second phase. As one illustrative example, this may include determining a difference value between the first projected flow rate of the first phase and the second projected flow rate of the second phase, then using that difference value to determine a predicted volume of an excess of molten metal expected due to the transition, then determining a corresponding height that will provide that volume based on other factors such as surface area of a cross section of the mold and/or cast speed, and then using that height to inform a rate and duration of change of the casting speed to achieve such a volume to accommodate the excess of molten metal. In an illustrative example of implementation, a suitable cast speed can be predicted for mitigating overshoot or undershoot, introduced as a sudden change in casting speed at an appropriate time, and followed up with a slow progression back toward normal cast speed over a period of time to allow a pin position PID algorithm to track a speed of the metal level.

In some aspects, parameters of alteration of the casting speed to mitigate undershoot or overshoot may be determined without direct reliance on the predetermined casting recipe in a predictive manner. For example, in some aspects, an alteration of the casting speed is determined based on a difference value between the detected metal level and the metal level setpoint. As an illustrative example, a PID controller could be used to receive input in the form of metal level setpoint and actual metal level (e.g., from the metal level sensor 50) and respond by providing respective commands to adjust the casting speed of the bottom block to maintain the molten metal level relative to the mold 11. Put another way, the casting speed may be altered in response to the molten metal level detected in the mold 11 so that the molten metal level is maintained within a certain range relative to the mold 11.

Although FIGS. 3-4 have been discussed as representative of various examples with respect to techniques involving altering cast speed (e.g., of a bottom block 12) and/or moving a mold 11 to mitigate overshoot or undershoot, these figures are related to one example of a casting recipe and are not necessarily representative of certain other examples. A process is more generally described with respect to FIG. 6.

Figure 6:
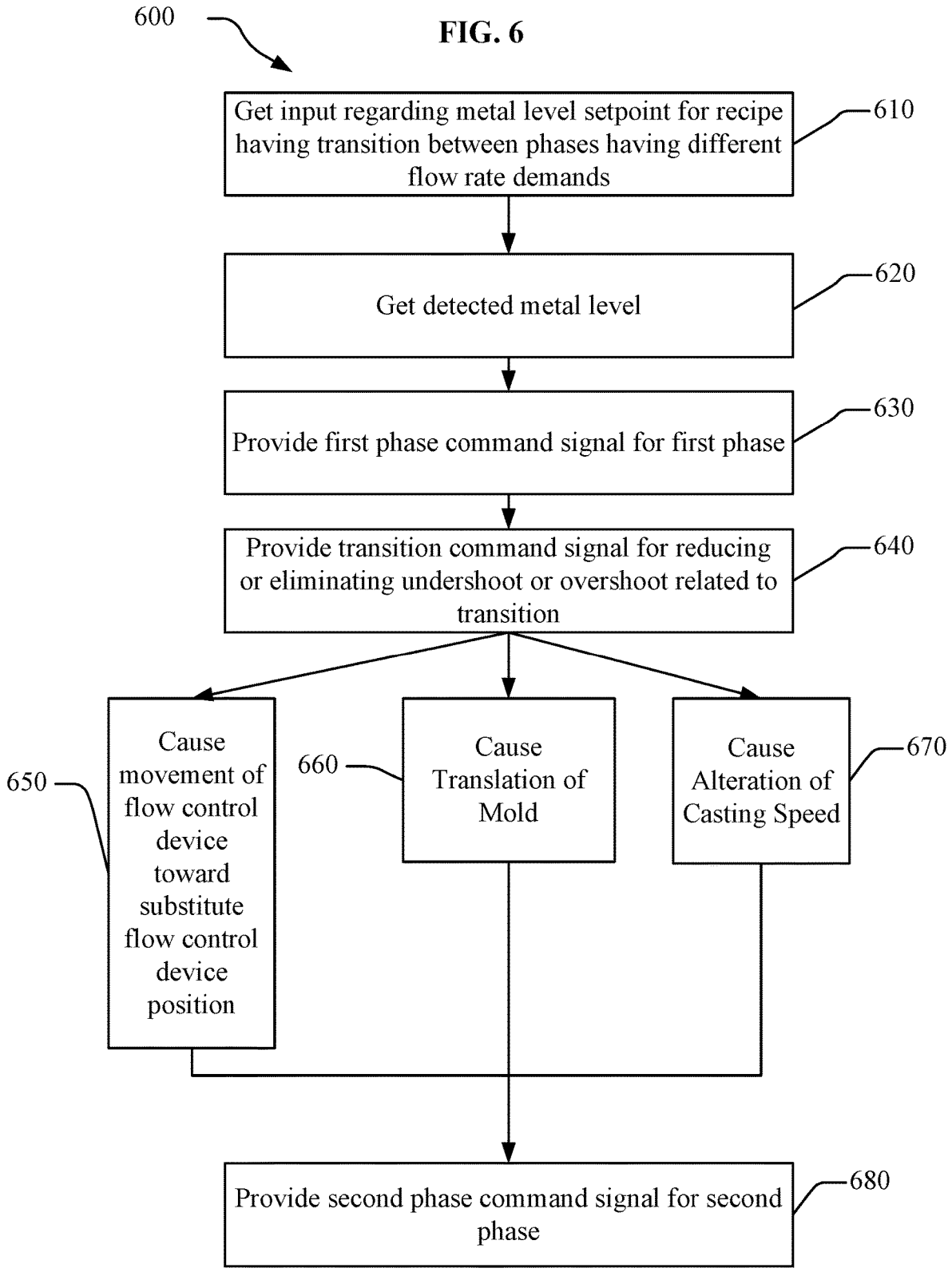
FIG. 6 is a flow chart illustrating another method of metal level delivery control according to various examples.

FIG. 6 is a flow chart illustrating another method 600 of metal level delivery control according to various examples. Various operations in the method 600 can be performed by the controller 52 and/or other elements described above.

Various actions of the method 600 may be similar to actions described in the method 500 and, as such, such description will not be repeated. For example, at 610 and 620, the method 600 may include actions similar to those described above with respect to actions 510 and 520 in method 500.

At 630, the method 600 includes providing a first phase command signal for the first phase. For example, the first phase command signal may differ from subsequent command signals provided for other phases or transitions. In some examples, the first phase command signal may provide automatic control of a pin position (or other adjustment of another flow control device) and/or automatic control of other elements of the apparatus for producing a cast ingot. In some examples, the first phase command signal may provide automatic control in the first phase based on metal level set point and detected metal level. This may correspond to controlling the pin position according to a PID or other algorithm. In some examples, the action described above at 530 may be an example of the action at 630.

At 640, the method 600 includes providing a transition command signal. The transition command signal can differ from the first phase command signal so as to reduce or eliminate overshoot or undershoot related to a transition between phases that have differing flow requirements. The transition command signal may have the effect of one or more of the actions indicated at 650, 660, or 670. For example, in some scenarios, the transition command signal may cause only one of the three actions indicated at 650, 660, and 670, while in other scenarios, the transition command signal may cause all three or some other sub-combination of the three actions indicated at 650, 660, and 670.

As a first option indicated at 650 in FIG. 6, the transition command signal may cause movement of a flow control device toward a substitute flow control device position. For example, this may correspond to actions described above with respect to techniques that involve pin position substitution, which may include, but are not limited to actions 540 and 550.

As a second option indicated at 660 in FIG. 6, the transition command signal may cause translation of a mold. The translation of the mold may change a height between the mold and a conduit that delivers molten metal to the mold. As a non-limiting example, the transition command signal at 660 may control the mold mover 13 of FIG. 1. In some examples, the translation of the mold can cause the mold to move upward, such as to reduce overshoot that might otherwise occur as a result of the transition between the first and second phases having different flow demands. In some examples, the translation of the mold can cause the mold to move downward, such as to reduce undershoot that might otherwise occur as a result of the transition between the first and second phases having different flow demands. A rate or amount of the translation may be determined based on any suitable criteria. For example, the rate or amount of translation may be based on a difference value between the respective projected flow rates of the first and second phases. Additionally or alternatively, the rate or amount of translation may be based on a difference value between the detected metal level and the metal level setpoint.

As a third option indicated at 670 in FIG. 6, the transition command signal may cause alteration of a casting speed. The alteration of the casting speed may change a rate at which a bottom block or other support structure moves relative to the mold and/or relative to a conduit that delivers molten metal to the mold. As a non-limiting example, the transition command signal at 670 may control the speed at which the bottom block 12 of FIG. 1 moves. In some examples, the alteration of the casting speed can cause a temporary increase in the casting speed, such as to reduce overshoot that might otherwise occur as a result of the transition between the first and second phases having different flow demands. In some examples, the alteration of the casting speed can cause a temporary decrease in the casting speed, such as to reduce undershoot that might otherwise occur as a result of the transition between the first and second phases having different flow demands. A magnitude of the change of casting speed (and/or an acceleration at which the change is implemented) may be determined based on any suitable criteria. For example, the magnitude and/or acceleration for the change of casting speed may be based on a difference value between the respective projected flow rates of the first and second phases. Additionally or alternatively, magnitude and/or acceleration for the change of casting speed may be based on a difference value between the detected metal level and the metal level setpoint. In various examples, altering the casting speed also includes implementing a return or convergence toward a steady or baseline casting speed of a casting recipe following the temporary change to the casting speed. For example, following a temporary increase in casting speed, the casting speed may undergo a subsequent decrease to resume a baseline casting speed, or following a temporary decrease in casting speed, the casting speed may undergo a subsequent increase to resume a baseline casting speed. The convergence may be implemented in any fashion, including, but not limited to, a linearly ramped shift from the altered casting speed to the baseline casting speed.

At 680, the method 600 includes providing a second phase command signal for the second phase. In some examples, the second phase command signal may provide automatic control of a pin position (or other adjustment of another flow control device) and/or automatic control of other elements of the apparatus for producing a cast ingot. In some examples, the second phase command signal may provide automatic control in the second phase based on metal level set point and detected metal level. This may correspond to controlling the pin position according to a PID or other algorithm. In some examples, the action described above at 560 may be an example of the action at 680. In general, the action at 680 may correspond to ongoing control following an intervening transition command signal implemented to mitigate overshoot or undershoot that might otherwise occur or be more prominent as a result of the transition between phases that have different flow demands. In some examples, the transition command signal may disrupt ongoing control for a brief amount of time, such as for less than 0.5 seconds or a single scan of the system, although in some other examples, the transition command signal may disrupt or supplement ongoing control for more extended periods of time.

The following examples will serve to further illustrate the present invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention.

As used below, any reference to a series of examples is to be understood as a reference to each of those examples disjunctively (e.g., "Examples 1-4" is to be understood as "Examples 1, 2, 3, or 4").

Example 1A (which may incorporate features of any of the other examples herein) is a method of delivering molten metal in a casting process, comprising: providing a mold apparatus, the mold apparatus comprising: a mold; a conduit configured to deliver the molten metal to the mold, the conduit controllably occluded by a control pin; a positioner coupled to the control pin; a level sensor configured to sense a level of the molten metal in the mold; and a controller coupled with the positioner and the level sensor; providing input to the controller in the form of a metal level setpoint that is variable over time according to a casting recipe having at least a first phase, a transition point, and a second phase, wherein the first phase has a first projected flow rate that differs from a second projected flow rate of the second phase, and wherein the transition point corresponds to a point in time at which the first phase ends and the second phase begins; providing input to the controller from the level sensor in the form of a detected metal level; for the first phase, providing from the controller to the positioner a first pin position output command signal that is variable over time and includes a first varying pin position determined based on the detected metal level and the metal level setpoint for automatically controlling the control pin during the first phase to modulate flow or flow rate of the molten metal through the conduit such that the level of molten metal in the mold remains in a molten metal level range that is about the metal level setpoint; determining a substitute pin position value based on a difference between the first projected flow rate of the first phase and the second projected flow rate of the second phase; providing from the controller to the positioner the substitute pin position value in lieu of the first varying pin position at the transition point; and for the second phase, providing from the controller to the positioner a second pin position output command signal that is variable over time and includes a second varying pin position determined based on the detected metal level and the metal level setpoint for automatically controlling the control pin during the second phase.

Example 2A is the method according to claim 1A (or any of the preceding or subsequent Examples), wherein determining the substitute pin position value based on the difference between the first projected flow rate of the first phase and the second projected flow rate of the second phase further comprises: determining, by the controller, a percentage difference between the first projected flow rate of the first phase and the second projected flow rate of the second phase; and determining the substitute pin position value by modifying the first varying pin position at or near an end of the first phase by the percentage difference determined between the first projected flow rate of the first phase and the second projected flow rate of the second phase.

Example 3A is the method according to claim 1A (or any of the preceding or subsequent Examples), wherein the first projected flow rate of the first phase is greater than the second projected flow rate of the second phase; and wherein providing from the controller to the positioner the substitute pin position value for the first varying pin position at the transition point mitigates overshoot.

Example 4A is the method according to claim 1A (or any of the preceding or subsequent Examples), wherein the first projected flow rate of the first phase is less than the second projected flow rate of the second phase; and wherein providing from the controller to the positioner the substitute pin position value for the first varying pin position at the transition point mitigates undershoot.

Example 5A is the method according to claim 1A (or any of the preceding or subsequent Examples), wherein automatic control based on the detected metal level and the metal level setpoint is disrupted for less than 0.5 seconds for providing the substitute pin position value at the transition point.

Example 6A is the method according to claim 1A (or any of the preceding or subsequent Examples), wherein the controller is a proportional-integral-derivative (PID) controller that includes a PID algorithm for controlling the level of the molten metal in the mold in a casting of aluminum, the controller configured to accept or determine at least one metal level setpoint.

Example 7A (which may incorporate features of any of the other examples herein) is a mold apparatus for casting metal, comprising: a mold; a conduit configured to deliver molten metal to the mold, the conduit controllably occluded by a flow control device; a positioner coupled to the flow control device; a level sensor configured to sense a level of the molten metal in the mold; and a controller coupled with the positioner and the level sensor, the controller comprising a processor adapted to execute code stored on a non-transitory computer-readable medium in a memory of the controller, the controller being programmed by the code to: accept or determine input in the form of a metal level setpoint that is variable over time according to a casting recipe having at least a first phase, a transition time, and a second phase, wherein the first phase has a first projected flow rate that differs from a second projected flow rate of the second phase, and wherein the transition time corresponds to a time between an end of the first phase and a beginning of the second phase; accept input from the level sensor in the form of a detected metal level; provide to the positioner, a first command signal that automatically controls the flow control device during the first phase to modulate flow or flow rate of molten metal through the conduit based on the detected metal level and the metal level setpoint such that the level of molten metal in the mold remains in a molten metal level range that is about the metal level setpoint; provide to the positioner, a transition command signal that moves the flow control device in the transition time toward a substitute flow control device position determined based on a difference between the first projected flow rate of the first phase and the second projected flow rate of the second phase; and provide to the positioner, a second command signal that automatically controls the flow control device during the second phase based on the detected metal level and the metal level setpoint.

Example 8A is the apparatus according to claim 7A (or any of the preceding or subsequent Examples), wherein the controller is programmed by the code to further determine the substitute flow control device position based on a difference between the first projected flow rate of the first phase and the second projected flow rate of the second phase.

Example 9A is the apparatus according to claim 8A (or any of the preceding or subsequent Examples), wherein the controller being programmed by the code to further determine the substitute flow control device position based on the difference between the first projected flow rate of the first phase and the second projected flow rate of the second phase comprises: determining, by the controller, a difference value between the first projected flow rate of the first phase and the second projected flow rate of the second phase; and determining the substitute flow control device position by modifying a flow control device position at or near the end of the first phase according to a linear relationship with the difference value.

Example 10A is the apparatus according to claim 7A (or any of the preceding or subsequent Examples), wherein the first projected flow rate of the first phase is greater than the second projected flow rate of the second phase.

Example 11A is the apparatus according to claim 7A (or any of the preceding or subsequent Examples), wherein the first projected flow rate of the first phase is less than the second projected flow rate of the second phase.

Example 12A is the apparatus according to claim 7A (or any of the preceding or subsequent Examples), wherein the transition time is defined based on a single program scan.

Example 13A is the apparatus according to claim 7A (or any of the preceding or subsequent Examples), wherein the controller is a proportional-integral-derivative (PID) controller that includes a PID algorithm for casting of the metal.

Example 14A (which may incorporate features of any of the other examples herein) is a method of delivering molten metal in a casting process, comprising: accepting or determining, by a controller, input in the form of a metal level setpoint that is variable over time according to a casting recipe having at least a first phase, a transition time, and a second phase, wherein the first phase has a first projected flow rate that differs from a second projected flow rate of the second phase, and wherein the transition time corresponds to a time between an end of the first phase and a beginning of the second phase; accepting, by the controller, input in the form of a detected metal level from a level sensor coupled with the controller and configured to sense a level of the molten metal in a mold; providing a first command signal from the controller to a positioner coupled to flow control device controllably occluding a conduit configured to deliver the molten metal to the mold, the first command signal being configured to automatically control the flow control device during the first phase to modulate flow or flow rate of the molten metal through the conduit based on the detected metal level and the metal level setpoint such that the level of molten metal in the mold remains in a molten metal level range that is about the metal level setpoint; providing from the controller to the positioner a transition command signal that moves the flow control device in the transition time toward a substitute flow control device position determined based on a difference between the first projected flow rate of the first phase and the second projected flow rate of the second phase; and providing from the controller to the positioner, a second command signal that automatically controls the flow control device during the second phase based on the detected metal level and the metal level setpoint.

Example 15A is the method according to claim 14A (or any of the preceding or subsequent Examples), further comprising determining the substitute flow control device position based on a difference between the first projected flow rate of the first phase and the second projected flow rate of the second phase.

Example 16A is the method according to claim 15A (or any of the preceding or subsequent Examples), wherein determining the substitute flow control device position based on the difference between the first projected flow rate of the first phase and the second projected flow rate of the second phase comprises: determining a difference value between the first projected flow rate of the first phase and the second projected flow rate of the second phase; and determining the substitute flow control device position by modifying a flow control device position at or near the end of the first phase according to a linear relationship with the difference value.

Example 17A is the method according to claim 14A (or any of the preceding or subsequent Examples), wherein the first projected flow rate of the first phase is greater than the second projected flow rate of the second phase.

Example 18A is the method according to claim 14A (or any of the preceding or subsequent Examples), wherein the first projected flow rate of the first phase is less than the second projected flow rate of the second phase.

Example 19A is the method according to claim 14A (or any of the preceding or subsequent Examples), wherein the transition time is at least one of: defined based on a single program scan; or less than 0.5 seconds.

Example 20A is the method according to claim 14A (or any of the preceding or subsequent Examples), wherein the controller is a proportional-integral-derivative (PID) controller that includes a PID algorithm for casting of the molten metal.

Example 1B (which may incorporate features of any of the other examples herein) is an apparatus for casting metal, the apparatus comprising: a mold; a conduit configured to deliver molten metal to the mold, the conduit controllably occluded by a flow control device; a positioner coupled to the flow control device; a level sensor configured to sense a level of the molten metal in the mold; and a controller comprising a processor adapted to execute code stored on a non-transitory computer-readable medium in a memory of the controller, the controller being programmed by the code to: accept or determine input in the form of a metal level setpoint that is variable over time according to a casting recipe having at least a first phase, a transition time, and a second phase, wherein the first phase has a first projected flow rate that differs from a second projected flow rate of the second phase, and wherein the transition time corresponds to a time between an end of the first phase and a beginning of the second phase; accept input from the level sensor in the form of a detected metal level; and provide a transition command signal configured to achieve a goal of reducing or eliminating an amount of undershoot or overshoot related to the transition time, the transition command signal configured to achieve the goal by causing at least one of: (A) movement of the flow control device in the transition time toward a substitute flow control device position determined based on a difference between the first projected flow rate of the first phase and the second projected flow rate of the second phase; (B) translation of the mold to change a height between the mold and the conduit; or (C) alteration of a casting speed at or around the transition time to differ from during the second phase.

Example 2B is the apparatus according to claim 1B (or any of the preceding or subsequent Examples), wherein the transition command signal is configured to achieve the goal by causing (A), (B), and (C).

Example 3B is the apparatus according to claim 1B (or any of the preceding or subsequent Examples), wherein the transition command signal is configured to achieve the goal by causing (A) without also causing (B) and without also causing (C).

Example 4B is the apparatus according to claim 1B (or any of the preceding or subsequent Examples), wherein the transition command signal is configured to achieve the goal by causing (B) without also causing (A) and without also causing (C).

Example 5B is the apparatus according to claim 1B (or any of the preceding or subsequent Examples), wherein the transition command signal is configured to achieve the goal by causing (C) without also causing (A) and without also causing (B).

Example 6B is the apparatus according to any of example(s) 1B, 2B, or 3B (or any of the preceding or subsequent Examples), wherein the controller is programmed by the code to further: provide to the positioner, a first command signal that automatically controls the flow control device during the first phase to modulate flow or flow rate of molten metal through the conduit based on the detected metal level and the metal level setpoint such that the level of molten metal in the mold remains in a molten metal level range that is about the metal level setpoint; wherein the transition command signal is configured to achieve the goal by at least causing (A) so as to cause the movement of the flow control device in the transition time toward the substitute flow control device position determined based on the difference between the first projected flow rate of the first phase and the second projected flow rate of the second phase; and provide to the positioner, a second command signal that automatically controls the flow control device during the second phase based on the detected metal level and the metal level setpoint.

Example 7B is the apparatus according to any of example(s) 1B, 2B, 3B, or 6B (or any of the preceding or subsequent Examples), wherein the transition command signal is configured to achieve the goal by at least causing (A), wherein the controller is programmed by the code to further determine the substitute flow control device position based on a difference between the first projected flow rate of the first phase and the second projected flow rate of the second phase.

Example 8B is the apparatus according to claim 7B (or any of the preceding or subsequent Examples), wherein the controller being programmed by the code to further determine the substitute flow control device position based on the difference between the first projected flow rate of the first phase and the second projected flow rate of the second phase comprises: determining, by the controller, a difference value between the first projected flow rate of the first phase and the second projected flow rate of the second phase; and determining the substitute flow control device position by modifying a flow control device position at or near the end of the first phase according to a linear relationship with the difference value.

Example 9B is the apparatus according to any of example(s) 1B, 2B, 3B, 6B, 7B, or 8B (or any of the preceding or subsequent Examples), wherein the transition command signal is configured to achieve the goal by at least causing (A), wherein the controller is a proportional-integral-derivative (PID) controller that includes a PID algorithm for casting of the metal.

Example 10B is the apparatus according to any of example(s) 1B, 2B, or 4B, wherein the transition command signal is configured to achieve the goal by at least causing (B), wherein the apparatus further comprises one or more actuators coupled with the mold and configured to at least one of raise or lower the mold relative to the conduit.

Example 11B is the apparatus according to any of example(s) 1B, 2B, 4B, or 10B (or any of the preceding or subsequent Examples), wherein the transition command signal is configured to achieve the goal by at least causing (B), wherein the translation of the mold comprises raising the mold to reduce a height between the mold and the conduit so as to mitigate overshoot.

Example 12B is the apparatus according to any of example(s) 1B, 2B, 4B, 10B or 11B (or any of the preceding or subsequent Examples), wherein the transition command signal is configured to achieve the goal by at least causing (B), wherein a rate or amount of translation of the mold is determined based on a difference value between the first projected flow rate of the first phase and the second projected flow rate of the second phase.

Example 13B is the apparatus according to any of example(s) 1B, 2B, 4B, 10B or 11B (or any of the preceding or subsequent Examples), wherein the transition command signal is configured to achieve the goal by at least causing (B), wherein a rate or amount of translation of the mold is determined based on a difference value between the detected metal level and the metal level setpoint.

Example 14B is the apparatus according to any of example(s) 1B, 2B, or 5B (or any of the preceding or subsequent Examples), wherein the transition command signal is configured to achieve the goal by at least causing (C), wherein the apparatus further comprises a bottom block configured for (i) movement downward from the conduit and (ii) for supporting an ingot formed by the molten metal delivered to the mold, wherein the casting speed comprises a rate at which the bottom block moves downward from the conduit.

Example 15B is the apparatus according to any of example(s) 1B, 2B, 5B, or 14B (or any of the preceding or subsequent Examples), wherein the transition command signal is configured to achieve the goal by at least causing (C), wherein alteration of a casting speed during the transition time comprises causing the casting speed at or around the transition time to be greater than during the second phase so as to mitigate overshoot.

Example 16B is the apparatus according to any of example(s) 1B, 2B, 5B, 14B, or 15B (or any of the preceding or subsequent Examples), wherein the transition command signal is configured to achieve the goal by at least causing (C), wherein the amount of alteration of the casting speed is determined based on a difference value between the first projected flow rate of the first phase and the second projected flow rate of the second phase.

Example 17B is the apparatus according to any of example(s) 1B, 2B, 5B, 14B, or 15B (or any of the preceding or subsequent Examples), wherein the transition command signal is configured to achieve the goal by at least causing (C), wherein the amount of alteration of the casting speed is determined based on a difference value between the detected metal level and the metal level setpoint.

Example 18B is the apparatus according to any of example(s) 1B-17B (or any of the preceding or subsequent Examples), wherein the first projected flow rate of the first phase is greater than the second projected flow rate of the second phase; and wherein the transition command signal mitigates overshoot, wherein the overshoot corresponds to the detected metal level exceeding the metal level setpoint by a threshold value.

Example 19B is the apparatus according to any of example(s) 1B-17B (or any of the preceding or subsequent Examples), wherein the first projected flow rate of the first phase is less than the second projected flow rate of the second phase; and wherein the transition command signal mitigates undershoot, wherein the undershoot corresponds to the detected metal level falling below the metal level setpoint by a threshold value.

Example 20B is the apparatus according to any of example(s) 1B-19B (or any of the preceding Examples), wherein the transition time is at least one of: defined based on a single program scan; or less than 0.5 seconds.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

That which is claimed is:

1. An apparatus for casting metal, the apparatus comprising:

a mold;

a conduit configured to deliver molten metal to the mold, the conduit controllably occluded by a flow control device;

a positioner coupled to the flow control device;

a level sensor configured to sense a level of the molten metal in the mold; and a controller comprising a processor adapted to execute code stored on a non-transitory computer-readable medium in a memory of the controller, the controller being programmed by the code to:

accept or determine input in the form of a metal level setpoint that is variable over time according to a casting recipe having at least a first phase, a transition time, and a second phase, wherein the first phase has a first projected flow rate that differs from a second projected flow rate of the second phase, and wherein the transition time corresponds to a time between an end of the first phase and a beginning of the second phase;

accept input from the level sensor in the form of a detected metal level; and provide a transition command signal configured to achieve a goal of reducing or eliminating an amount of undershoot or overshoot related to the transition time, the transition command signal configured to achieve the goal by causing at least one of:

(A) movement of the flow control device in the transition time toward a substitute flow control device position determined based on a difference between the first projected flow rate of the first phase and the second projected flow rate of the second phase;

(B) translation of the mold to change a height between the mold and the conduit; or (C) alteration of a casting speed at or adjacent the transition time to differ from during the second phase.

2. The apparatus according to claim 1, wherein the transition command signal is configured to achieve the goal by causing (A), (B), and (C).

3. The apparatus according to claim 1, wherein the transition command signal is configured to achieve the goal by causing (A) without also causing (B) and without also causing (C).

4. The apparatus according to claim 1, wherein the transition command signal is configured to achieve the goal by causing (B) without also causing (A) and without also causing (C).

5. The apparatus according to claim 1, wherein the transition command signal is configured to achieve the goal by causing (C) without also causing (A) and without also causing (B).

6. The apparatus according to claim 1, wherein the controller is programmed by the code to further:

provide to the positioner, a first command signal that automatically controls the flow control device during the first phase to modulate flow or flow rate of molten metal through the conduit based on the detected metal level and the metal level setpoint such that the level of molten metal in the mold remains in a molten metal level range having endpoints on either side of the metal level setpoint;

wherein the transition command signal is configured to achieve the goal by at least causing (A) so as to cause the movement of the flow control device in the transition time toward the substitute flow control device position determined based on the difference between the first projected flow rate of the first phase and the second projected flow rate of the second phase; and provide to the positioner, a second command signal that automatically controls the flow control device during the second phase based on the detected metal level and the metal level setpoint.

7. The apparatus according to claim 1, wherein the transition command signal is configured to achieve the goal by at least causing (A), wherein the controller is programmed by the code to further determine the substitute flow control device position based on a difference between the first projected flow rate of the first phase and the second projected flow rate of the second phase.

8. The apparatus according to claim 7, wherein the controller being programmed by the code to further determine the substitute flow control device position based on the difference between the first projected flow rate of the first phase and the second projected flow rate of the second phase comprises:

determining, by the controller, a difference value between the first projected flow rate of the first phase and the second projected flow rate of the second phase; and determining the substitute flow control device position by modifying a flow control device position at or adjacent the end of the first phase according to a linear relationship with the difference value.

9. The apparatus according to claim 1, wherein the transition command signal is configured to achieve the goal by at least causing (A), wherein the controller is a proportional-integral-derivative (PID) controller that includes a PID algorithm for casting of the metal.

10. The apparatus according to claim 1, wherein the transition command signal is configured to achieve the goal by at least causing (B), wherein the apparatus further comprises one or more actuators coupled with the mold and configured to at least one of raise or lower the mold relative to the conduit.

11. The apparatus according to claim 1, wherein the transition command signal is configured to achieve the goal by at least causing (B), wherein the translation of the mold comprises raising the mold to reduce a height between the mold and the conduit so as to mitigate overshoot.

12. The apparatus according to claim 1, wherein the transition command signal is configured to achieve the goal by at least causing (B), wherein a rate or amount of translation of the mold is determined based on a difference value between the first projected flow rate of the first phase and the second projected flow rate of the second phase.

13. The apparatus according to claim 1, wherein the transition command signal is configured to achieve the goal by at least causing (B), wherein a rate or amount of translation of the mold is determined based on a difference value between the detected metal level and the metal level setpoint.

14. The apparatus according to claim 1, wherein the transition command signal is configured to achieve the goal by at least causing (C), wherein the apparatus further comprises a bottom block configured for (i) movement downward from the conduit and (ii) for supporting an ingot formed by the molten metal delivered to the mold, wherein the casting speed comprises a rate at which the bottom block moves downward from the conduit.

15. The apparatus according to claim 1, wherein the transition command signal is configured to achieve the goal by at least causing (C), wherein alteration of a casting speed during the transition time comprises causing the casting speed at or adjacent the transition time to be greater than during the second phase so as to mitigate overshoot.

16. The apparatus according to claim 1, wherein the transition command signal is configured to achieve the goal by at least causing (C), wherein the amount of alteration of the casting speed is determined based on a difference value between the first projected flow rate of the first phase and the second projected flow rate of the second phase.

17. The apparatus according to claim 1, wherein the transition command signal is configured to achieve the goal by at least causing (C), wherein the amount of alteration of the casting speed is determined based on a difference value between the detected metal level and the metal level setpoint.

18. The apparatus according to claim 1, wherein the first projected flow rate of the first phase is greater than the second projected flow rate of the second phase; and wherein the transition command signal mitigates overshoot, wherein the overshoot corresponds to the detected metal level exceeding the metal level setpoint by a threshold value.

19. The apparatus according to claim 1, wherein the first projected flow rate of the first phase is less than the second projected flow rate of the second phase; and wherein the transition command signal mitigates undershoot, wherein the undershoot corresponds to the detected metal level falling below the metal level setpoint by a threshold value.

20. The apparatus according to claim 1, wherein the transition time is at least one of:

defined based on a single program scan; or less than 0.5 seconds.

* * * * *